US009981788B2

(12) United States Patent
Skinner

(10) Patent No.: US 9,981,788 B2
(45) Date of Patent: May 29, 2018

(54) CHILD-RESISTANT PACKAGE

(71) Applicant: Ingersoll Paper Box Co., Limited, Ingersoll, Ontario (CA)

(72) Inventor: John Skinner, Alymer (CA)

(73) Assignee: INGERSOLL PAPER BOX CO., LIMITED (CA)

( * ) Notice: Subject to any disclaimer, the term of this patent is extended or adjusted under 35 U.S.C. 154(b) by 944 days.

(21) Appl. No.: 14/321,580

(22) Filed: Jul. 1, 2014

(65) Prior Publication Data

US 2016/0001937 A1 Jan. 7, 2016

(51) Int. Cl.

| | |
|---|---|
| ***B65D 5/38*** | (2006.01) |
| ***A45C 13/10*** | (2006.01) |
| ***B65D 50/04*** | (2006.01) |

(52) U.S. Cl.

CPC ..... *B65D 50/046* (2013.01); *B65D 5/38* (2013.01); *B65D 2215/02* (2013.01)

(58) Field of Classification Search

CPC .... A45C 13/10; A45C 13/18; B65D 2215/02; B65D 5/38; B65D 50/046; B65D 83/04; B65D 85/42

USPC ..... 206/1.5, 150, 528, 531–532, 538–539, 206/807; 229/125.125; 220/540, 542

See application file for complete search history.

(56) References Cited

U.S. PATENT DOCUMENTS

| | | | | |
|---|---|---|---|---|
| 2,426,856 A | | 9/1947 | Berg | |
| 3,648,918 A | | 3/1972 | Van Inwagen | |
| 3,761,010 A | | 9/1973 | Rosenburg, Jr. | |
| 4,401,210 A | | 8/1983 | Anjou | |
| 4,561,544 A | * | 12/1985 | Reeve | B65D 11/12 206/1.5 |
| 4,946,057 A | * | 8/1990 | Connolly | B65D 43/12 206/45.28 |

(Continued)

FOREIGN PATENT DOCUMENTS

| | | |
|---|---|---|
| CA | 2586270 | 12/2008 |
| CA | 2685890 | 3/2014 |

(Continued)

OTHER PUBLICATIONS

Printer News, Security for New Product Development; Packageprinting.com; Sep. 2013; p. 40.

*Primary Examiner* — Anthony Stashick
*Assistant Examiner* — Kaushikkumar Desai
(74) *Attorney, Agent, or Firm* — Steven M. Greenberg; CRGO Law

(57) ABSTRACT

A child-resistant package comprises a carton and a tray removably slidably receivable in the carton with a releasable locking mechanism. A laterally displaceable locking tab is biased to extend outwardly from the tray, and the carton has an inner wall disposed interiorly of, spaced from and adjacent to an outer wall of the carton. A locking slot is formed in the inner wall for releasably receiving the locking tab and the outer wall has an inwardly depressible button adjacent the inner wall and in registration with the locking slot. When in registration with the locking slot, the locking tab moves into the locking slot, engaging an edge of the locking slot to resist withdrawal of the tray from the carton. Pushing the button inwardly pushes the locking tab out of the locking slot, enabling the locking tab to slide along the inner wall of the carton for withdrawing the tray.

7 Claims, 12 Drawing Sheets

(56) References Cited

U.S. PATENT DOCUMENTS

| | | | | |
|---|---|---|---|---|
| 5,080,222 | A | 1/1992 | McNary | |
| 6,931,895 | B1 * | 8/2005 | Ahn | E05B 73/0023 206/1.5 |
| 6,976,576 | B2 * | 12/2005 | Intini | A45D 33/20 206/1.5 |
| 7,549,541 | B2 * | 6/2009 | Brozell | B65D 83/0463 206/531 |
| 7,708,142 | B2 | 5/2010 | Ehrlund | |
| 7,757,843 | B2 * | 7/2010 | Katsis | A24F 27/00 206/1.5 |
| 7,854,325 | B2 | 12/2010 | Bentele | |
| 7,967,144 | B2 * | 6/2011 | Sack | B65D 83/0463 206/538 |
| 8,453,840 | B2 | 6/2013 | Wharton | |
| 8,499,936 | B2 * | 8/2013 | Albrecht | B65D 83/0463 206/528 |
| 2002/0056652 | A1 * | 5/2002 | Kawamura | A24F 15/12 206/37 |
| 2003/0085262 | A1 * | 5/2003 | Evans | B65D 5/38 229/102 |
| 2011/0036743 | A1 * | 2/2011 | Wharton | B65D 5/38 206/531 |

FOREIGN PATENT DOCUMENTS

| | | | |
|---|---|---|---|
| CN | 203005915 | U | 6/2013 |
| EP | 1700798 | B1 | 7/2008 |
| EP | 1260454 | B1 | 12/2008 |
| EP | 2305575 | A1 | 4/2011 |
| GB | 1494313 | | 12/1977 |
| WO | 2005068304 | A2 | 7/2005 |
| WO | 2007038771 | A1 | 4/2007 |
| WO | 2011021138 | A2 | 2/2011 |
| WO | 2011137526 | A1 | 11/2011 |

* cited by examiner 102
124
110
122
125
144
142
140
106
108
212a
202
SECTION Y-Y 112
104
150
110
148
126
124
125
123
122
302
144
142

112
122
124
Y
Y
144
140
110

112
125
122
144
124
140
302

Detail Z

CHILD-RESISTANT PACKAGE

TECHNICAL FIELD

The present disclosure relates to packaging, and in particular to child-resistant packaging.

BACKGROUND

Potentially hazardous materials such as household chemicals and pharmaceuticals are intended to be accessible to responsible adults while limiting access by children. One approach to limiting access is so-called "child-resistant packaging," a term which refers generally to packaging which, to be opened, requires steps that would not be immediately apparent to a child.

SUMMARY

According to one aspect of the present disclosure, a child-resistant package comprises a carton and a tray removably slidably receivable in the carton. When the tray is received in the carton, contents of the tray are inaccessible and the child-resistant package has a releasable locking mechanism for releasably locking the tray in the carton. The releasable locking mechanism comprises a laterally displaceable locking tab biased to extend outwardly from the tray. The carton has an inner wall disposed interiorly of an outer wall of the carton, and the inner wall is spaced from, and adjacent to, the outer wall of the carton. A locking slot is formed in the inner wall for releasably receiving the locking tab. An inwardly depressible button is formed on the outer wall of the carton adjacent the inner wall, with the button being in registration with the locking slot. Thus, when the locking tab is in registration with the locking slot, the locking tab is biased outwardly to move toward and into the locking slot and the locking tab engages an edge of the locking slot to resist withdrawal of the tray from the carton. Pushing inwardly on the button pushes the locking tab out of the locking slot to enable the locking tab to slide along the inner wall of the carton so that the tray can be withdrawn from the carton.

In another aspect, a tray blank for forming a tray for a child-resistant package is provided. The tray blank comprises a rectilinear floor panel. Two opposed side wall panels extend from the floor panel for forming the exterior side walls of the tray, and two opposed end wall panels extend from the floor panel for forming the exterior end walls of the tray. Ledge panels extend from each of the side wall panels and from each of the end wall panels for forming a perimeter ledge of the tray, and interior wall panels extend from each ledge panel so that when the tray blank is in the folded condition, the respective interior wall panels form the interior walls of the tray and are spaced apart from the respective exterior side walls and exterior end walls by the ledge panels. Support panels extend from each interior wall panel for engaging the floor in parallel relation therewith when the tray blank is in the folded condition. A tab slit is cut into one side wall panel to form a locking tab, which extends from the respective ledge panel. The tab extends toward the floor panel when the tray blank is in the unfolded condition, and extends away from the floor panel when the tray blank is in the folded condition. The locking tab is disposed between two spaced apart slits extending from the side wall panel, through the adjacent ledge panel, and through the adjacent interior side wall panel for forming, when the tray blank is in the folded condition, a resilient laterally displaceable region carrying the tab. The tray blank, in the unfolded condition, is generally planar. The boundaries between the respective panels are defined by fold lines formed in the tray blank to facilitate folding. In one embodiment, the tray blank is made from paperboard.

In a further aspect, a carton blank for forming a carton for a child-resistant package is provided. The carton blank comprises a rectilinear main panel. A first main end panel extends from a first side of the main panel, and a first outer side panel extends from a second side of the main panel, with the second side being adjacent the first side. A second outer side panel extends from a third side of the main panel, opposite the second side of the main panel. A base panel extends from the second outer side panel with the second outer side panel being between the base panel and the main panel, and a first inner side panel extends from the base panel opposite the second outer side panel. A main inner panel extends from the first inner side panel opposite the base panel so that the main inner panel and the main panel will be in parallel registration with one another when the carton blank is in a folded condition. A second inner side panel extends from the main inner panel opposite the first inner side panel and a support panel extends from the second inner side panel opposite the main inner panel. A button is formed by two spaced apart slits cut into the second outer side panel, and a locking slot is cut into at least the second inner side panel to be in registration with the button when the carton blank is in the folded condition. The carton blank, in the unfolded condition, is generally planar. The boundaries between the respective panels are defined by fold lines formed in the carton blank to facilitate folding. In one embodiment, the carton blank is made from paperboard.

BRIEF DESCRIPTION OF THE DRAWINGS

These and other features will become more apparent from the following description in which reference is made to the appended drawings wherein.

DETAILED DESCRIPTION

Figure 1:
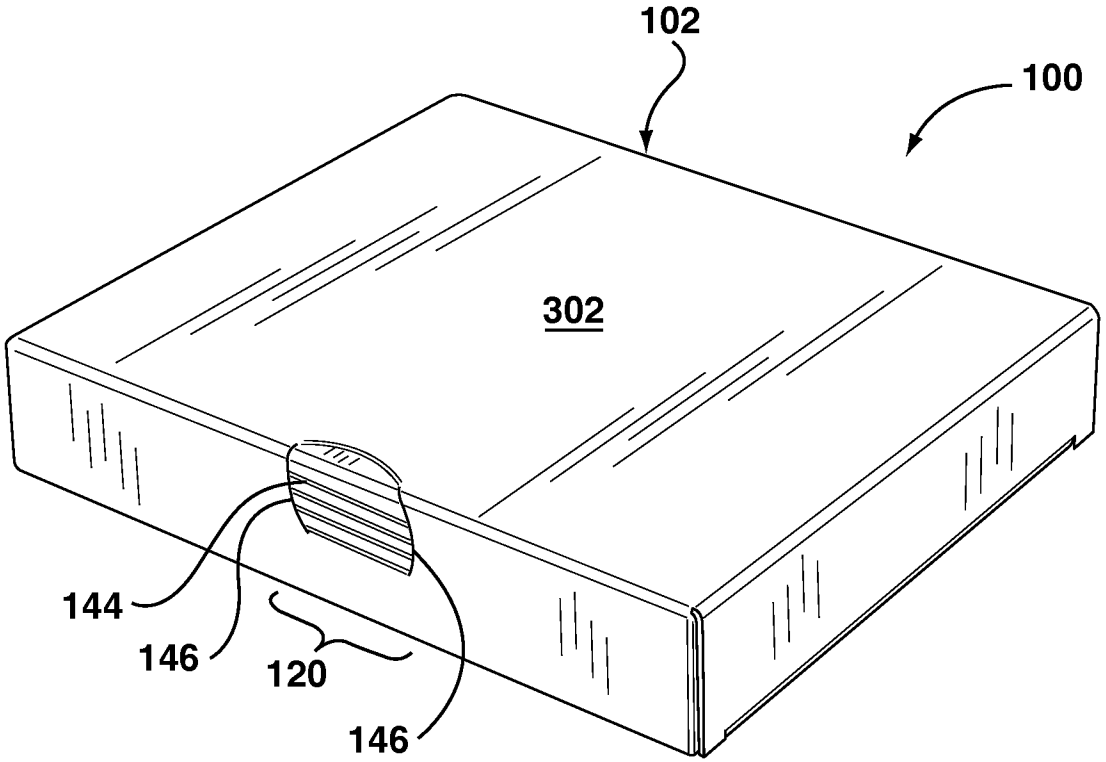
FIG. 1 is a top perspective view of an exemplary child-resistant package.
Figure 2:
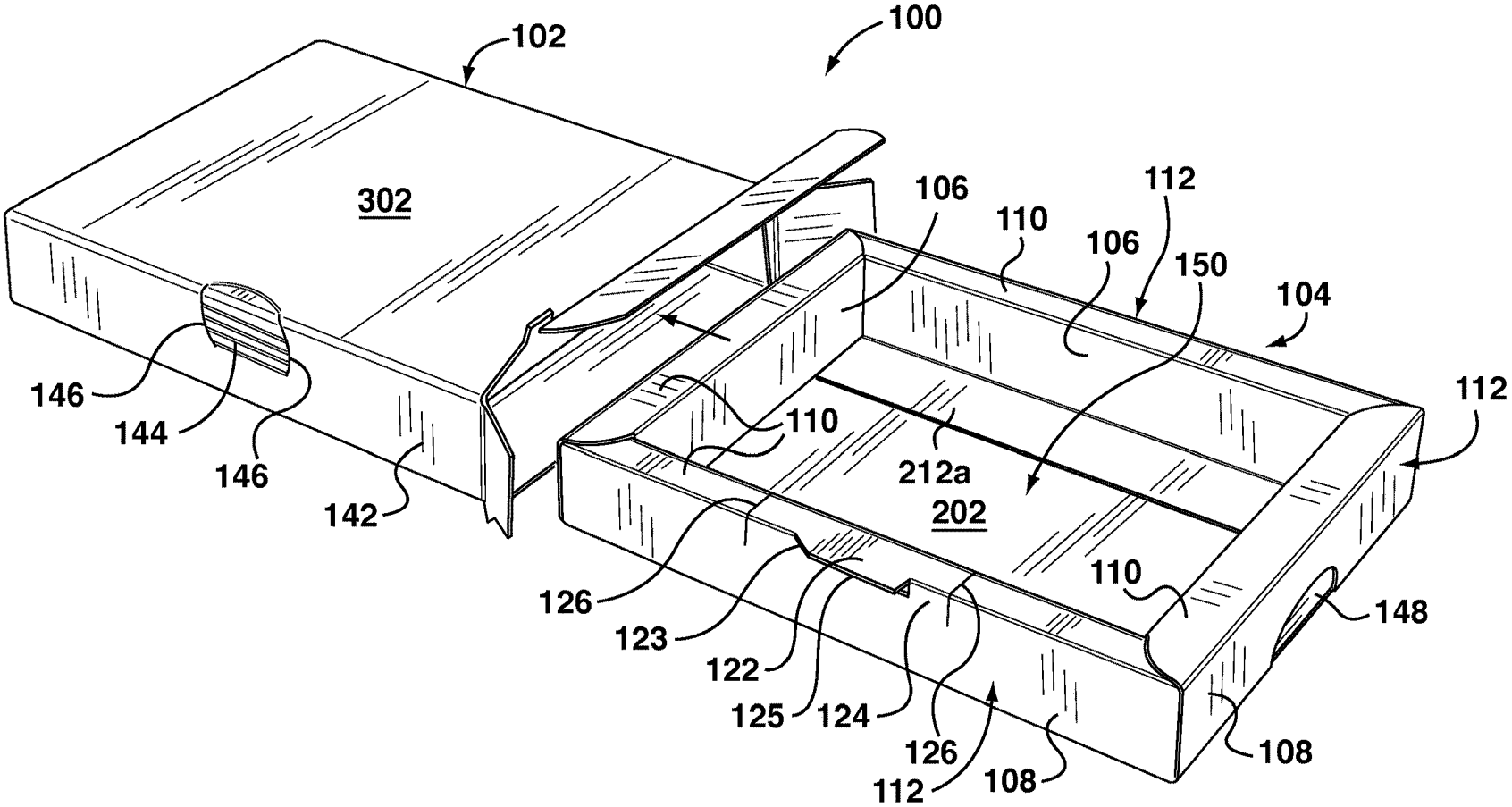
FIG. 2 is an exploded top perspective view of the child-resistant package of FIG. 1 showing a carton and a tray thereof.
Figure 3:
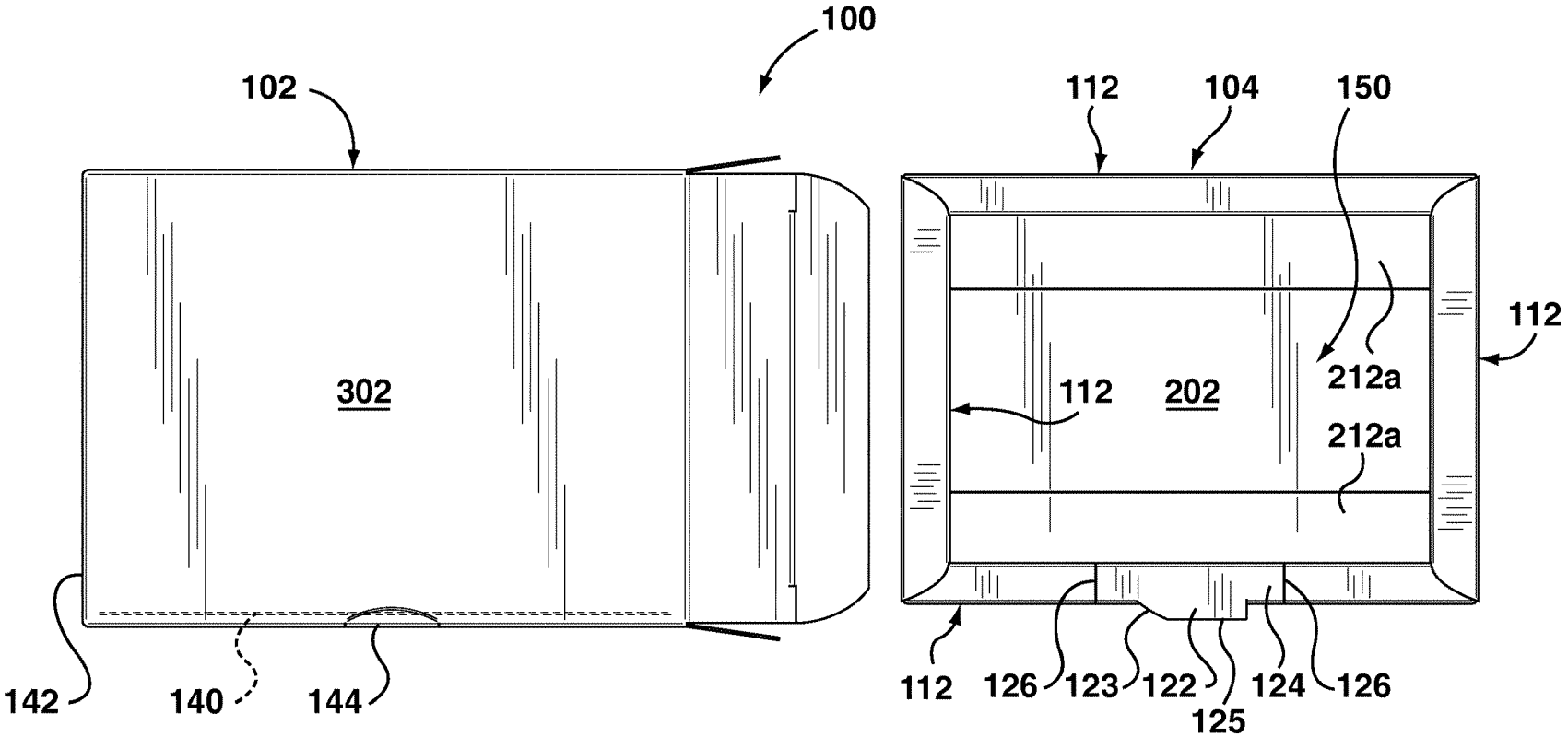
FIG. 3 is a top plan view of the carton and tray of FIG. 2.
Figure 6:
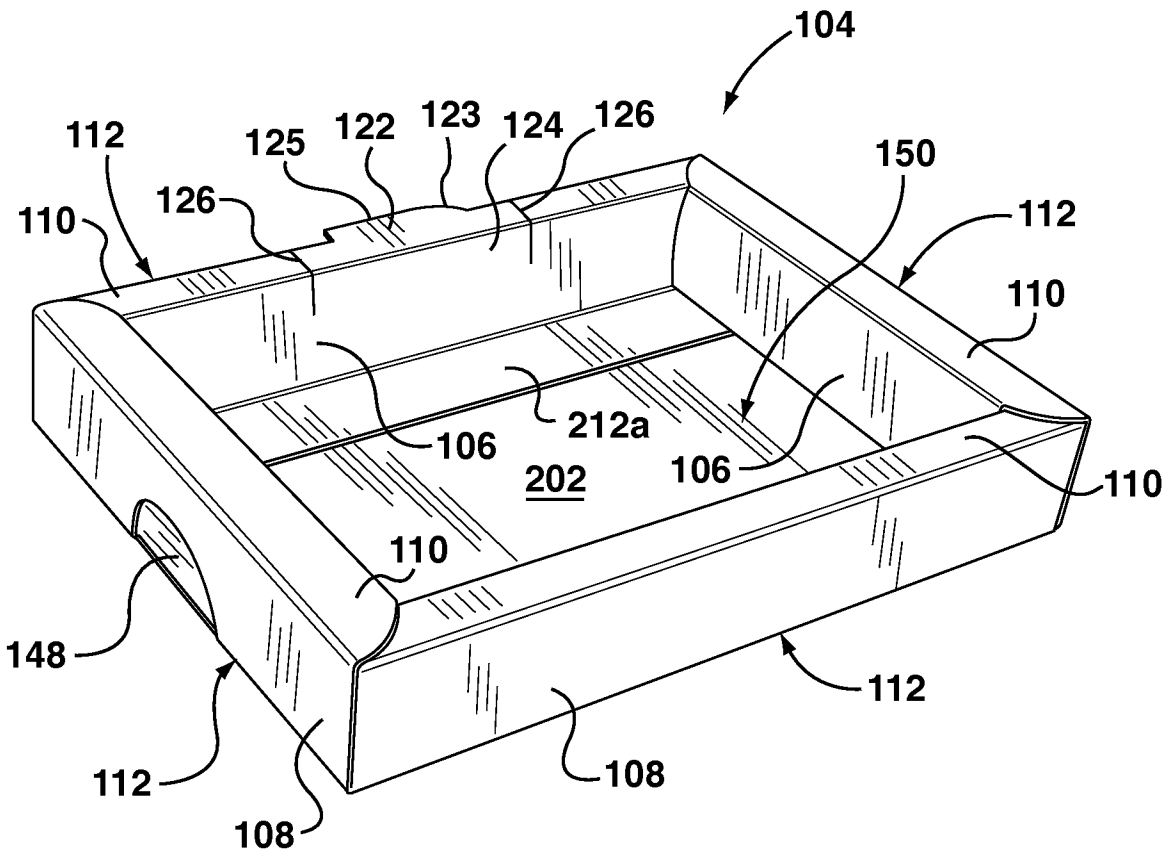
FIG. 6 is a top perspective view of the tray of FIG. 2.

An exemplary child-resistant package is indicated generally by the reference numeral 100 in the accompanying figures. Referring now to FIGS. 1 to 3, the child-resistant package 100 comprises a carton 102 and a tray 104 that is removably slidably receivable in the carton 102. A releasable locking mechanism 120 is provided for releasably locking the tray 104 in the carton 102 to increase the difficulty in opening the package and hence increase its child-resistance. As best seen in FIGS. 2 and 6, the tray 104 is rectilinear in plan and has four tray walls 112 each formed by an interior wall 106, exterior wall 108 and ledge 110; in the illustrated embodiment the respective interior wall 106 and exterior wall 108 of each tray wall 112 are parallel to one another and spaced apart by the respective ledge 110. The four tray walls 112 cooperate to form a tray cavity 150 for containing materials such as medication or the like. The tray cavity 150 is shown having a generally rectilinear cross-section but may be any suitable shape. Although shown as consisting of a single compartment, the tray cavity 150 may alternatively be divided into a plurality of distinct compartments.

In the illustrated embodiment, as will be explained further below, the carton 102 and tray 104 are each made from folded paperboard blanks; the paperboard used should be of sufficient strength to resist being easily torn, which would defeat the desired child-resistant properties. The paperboard will typically be multi-ply paperboard, and the term "paperboard" as used herein is intended to encompass structures which additionally include layers or coatings of suitable plastic to provide tear-resistance or barrier properties. Suitable types of paperboard for the present application are known to those of skill in the art and are not discussed further.

The releasable locking mechanism 120 comprises a laterally displaceable locking tab 122 biased to extend outwardly from the tray 104 and a corresponding locking slot in the carton 102. In the illustrated embodiment, the locking tab 122 is located on a resilient laterally displaceable region 124, rendering the locking tab 122 laterally displaceable. The laterally displaceable region 124 is formed by two spaced apart slits 126 in the tray wall 112 that carries the locking tab 122, as shown in FIGS. 2, 3, and 6. The two slits 126 are shown to be linear and substantially parallel in the accompanying figures but may formed at an angle relative to each other, curved relative to each other, or otherwise formed. In the illustrated embodiment, the two spaced apart slits 126 extend from the exterior wall 108, across the ledge 110, and into the interior wall 106 (FIGS. 2 and 6).

Figure 4A:
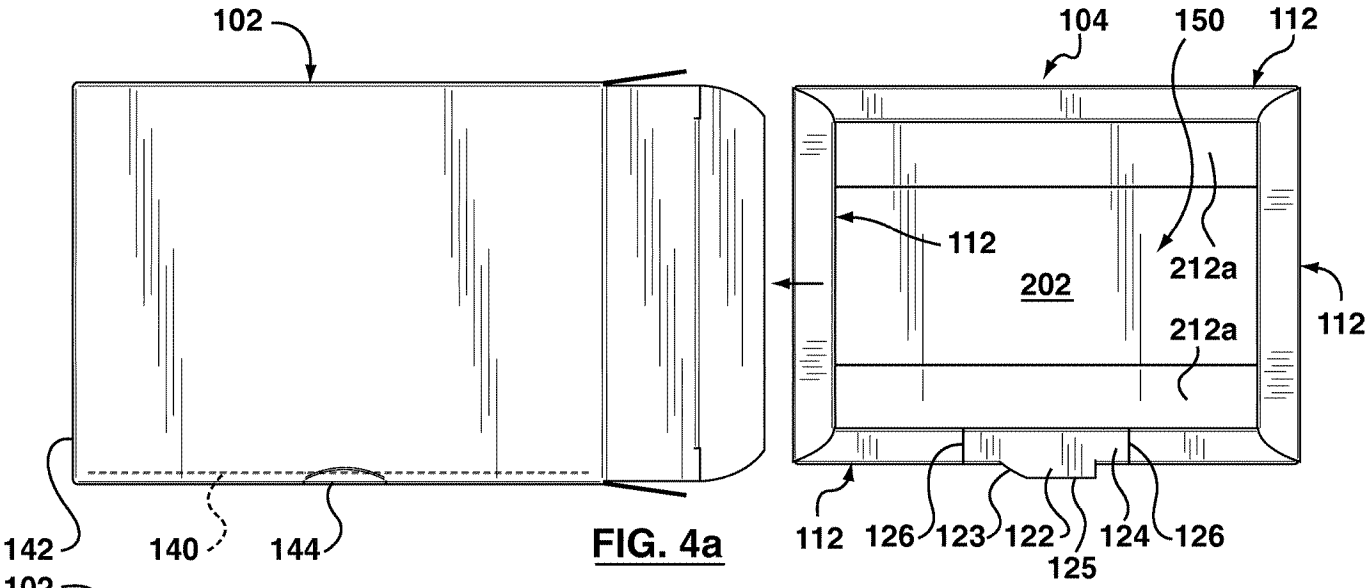
FIG. 4*a* is a top plan view showing the carton of FIG. 2 poised to slidably receive the tray of FIG. 2.
Figure 4B:
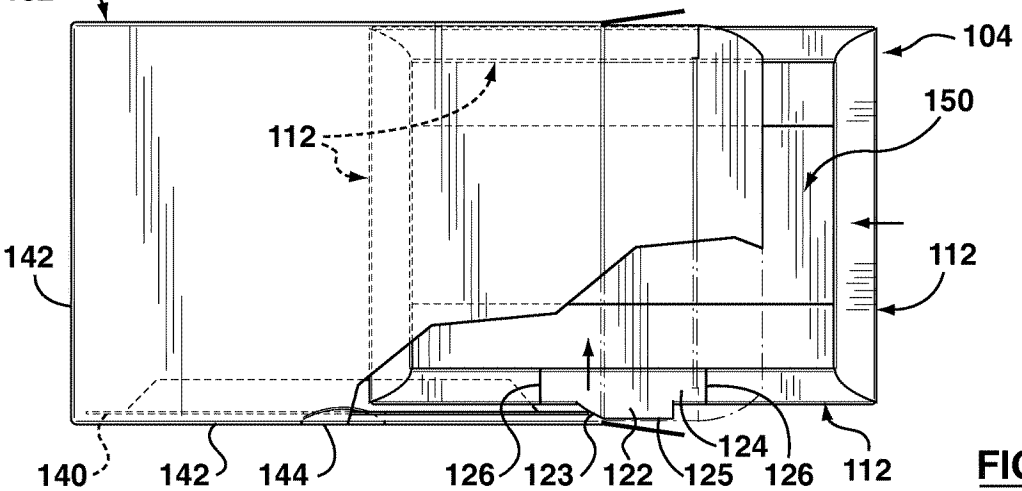
FIG. 4*b* is a partial cutaway top plan view showing the carton of FIG. 2 slidably receiving the tray of FIG. 2.
Figure 9A:
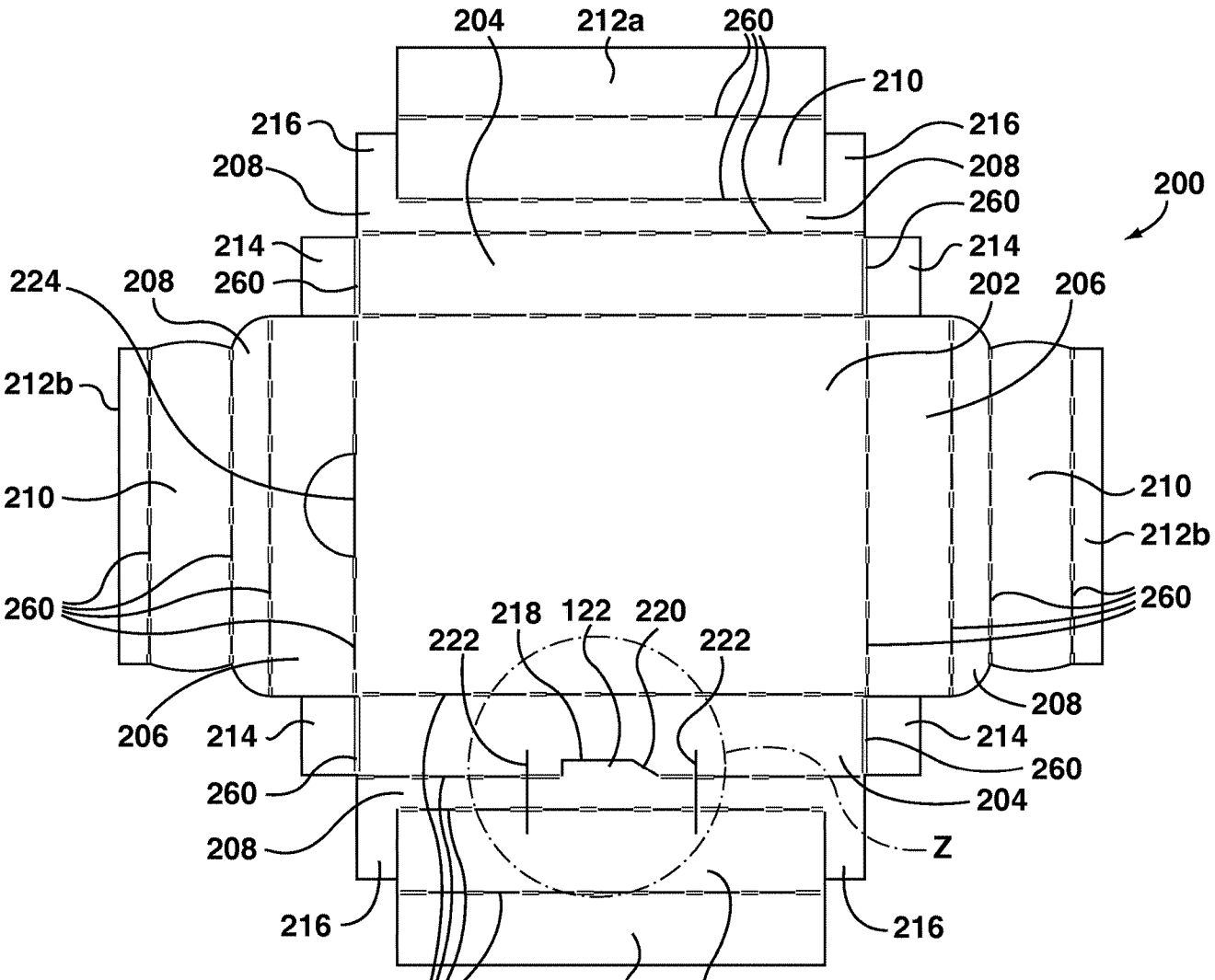
FIG. 9*a* is a plan view of an exemplary tray blank for constructing the tray of FIG. 2, shown in an unfolded condition.
Figure 9B:
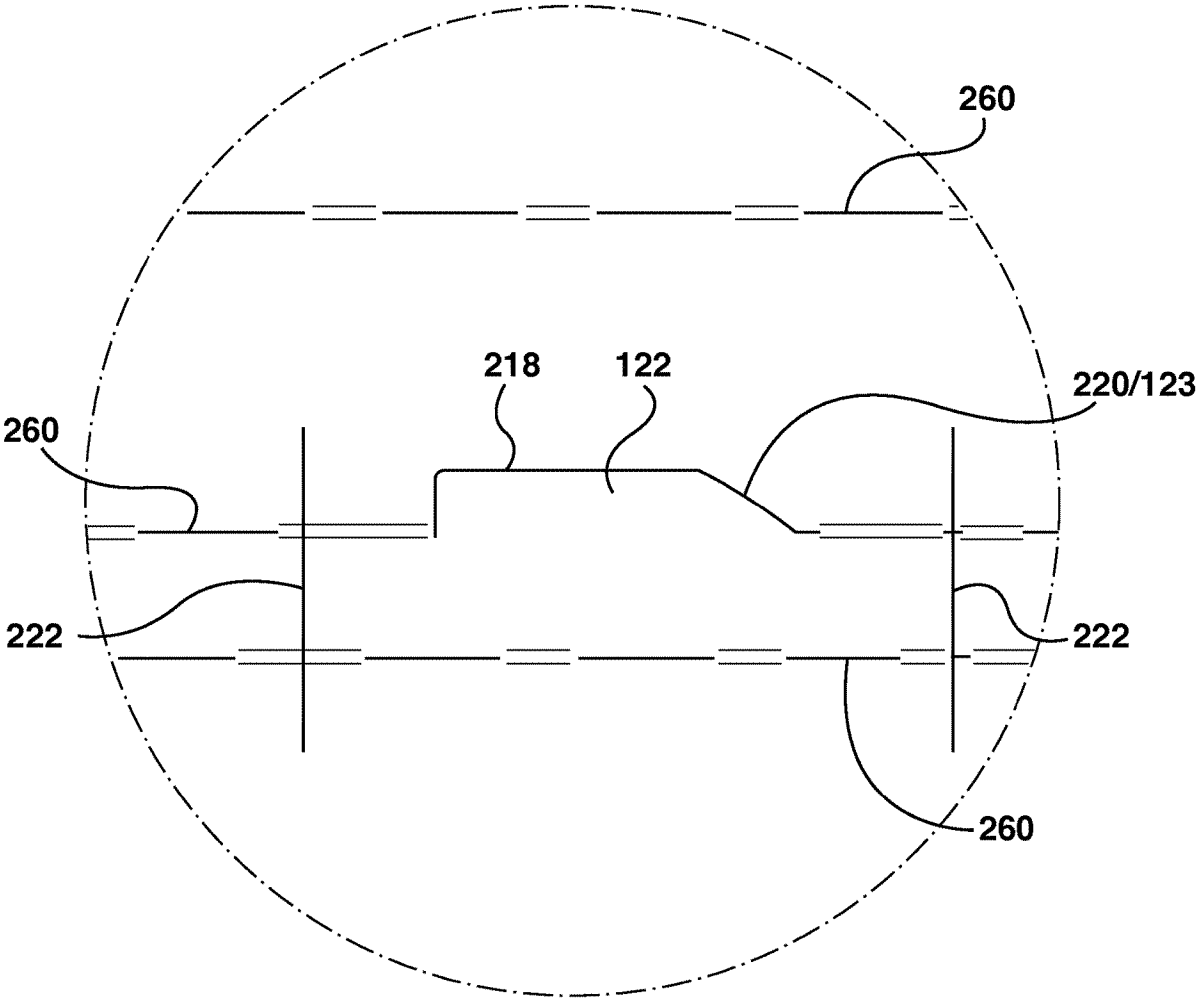
FIG. 9*b* is an enlargement of the circled portion Z of FIG. 8A.

Preferably, when inserting the tray 104 into the carton 102, contact between the locking tab 122 and the carton 102 guides the locking tab 122 inwardly, enabling insertion of the tray 104 into the carton 102 without significant obstruction by the locking tab 122. In a preferred embodiment, the locking tab 122 has a tapered edge 123; the locking tab 122 tapers inwardly in the direction of insertion of the tray 104 into the carton 102. As best seen in FIGS. 4*a* and 4*b*, as the tray 104 is slid into the carton 102, the tapered edge 123 of the locking tab 122 serves as a cam surface which is acted on by the inner wall 140 of the carton 102 to guide the locking tab 122 inwardly. Since the laterally displaceable region 124 carries the locking tab 122, this action moves the laterally displaceable region 124 inwardly as well. As the tray 104 continues to move into the carton 102, the locking tab 122 and laterally displaceable region 124 continue to be displaced inwardly until the outer edge 125 of the locking tab 122 is disposed inwardly of the inner wall 140 of the carton 102 (see FIGS. 4*b*, 5 and 7*a*). With the outer edge 125 of the locking tab 122 inside of the inner wall 140, the outer edge 125 of the locking tab 122 can slide along the inner wall 140 and the tray 104 can continue to move into the carton 102 until the tab 122 is aligned with the locking slot 130 (described in greater detail below). Thus, the tapered tab edge 123 guides the locking tab 122, and the laterally displaceable region 124 carrying the locking tab 122, towards the interior of the carton 102 during insertion of the tray 104 into the carton 102 while the locking tab 122 slides along the inner wall 140 toward the locking slot 130. As best seen in FIG. 9*b*, the tapered edge 123 of the locking tab may optionally have a slight convex curvature.

Referring now to FIGS. 7*a* to 7*d*, as the tray 104 continues to be inserted into the carton 102, the outer edge 125 of the locking tab 122 remains inside the inner wall 140 of the carton 102, maintained in that position by the inner wall 140, until the locking tab 122 is in registration with the locking slot 130. As illustrated, in a preferred embodiment the length of the carton 102 corresponds to the length of the tray 104 so that when the tray 104 is fully inserted into the carton 102, the locking tab 122 is in registration with the locking slot 130. Thus, when the locking tab 122 is in registration with the locking slot 130, the tray 104 will be encompassed by the carton 102 and will also be closely received on all sides. As can best be seen in FIG. 7*b*, when the tray 104 is fully received in the carton 102, the tray cavity 150 will be covered by the main panel 302 of the carton 102 which, in cooperation with the tray wall 112 disposed at the opening of the carton 102 into which the tray 104 is inserted, renders the contents of the tray 104 inaccessible even when the carton 102 is open.

Figure 5:
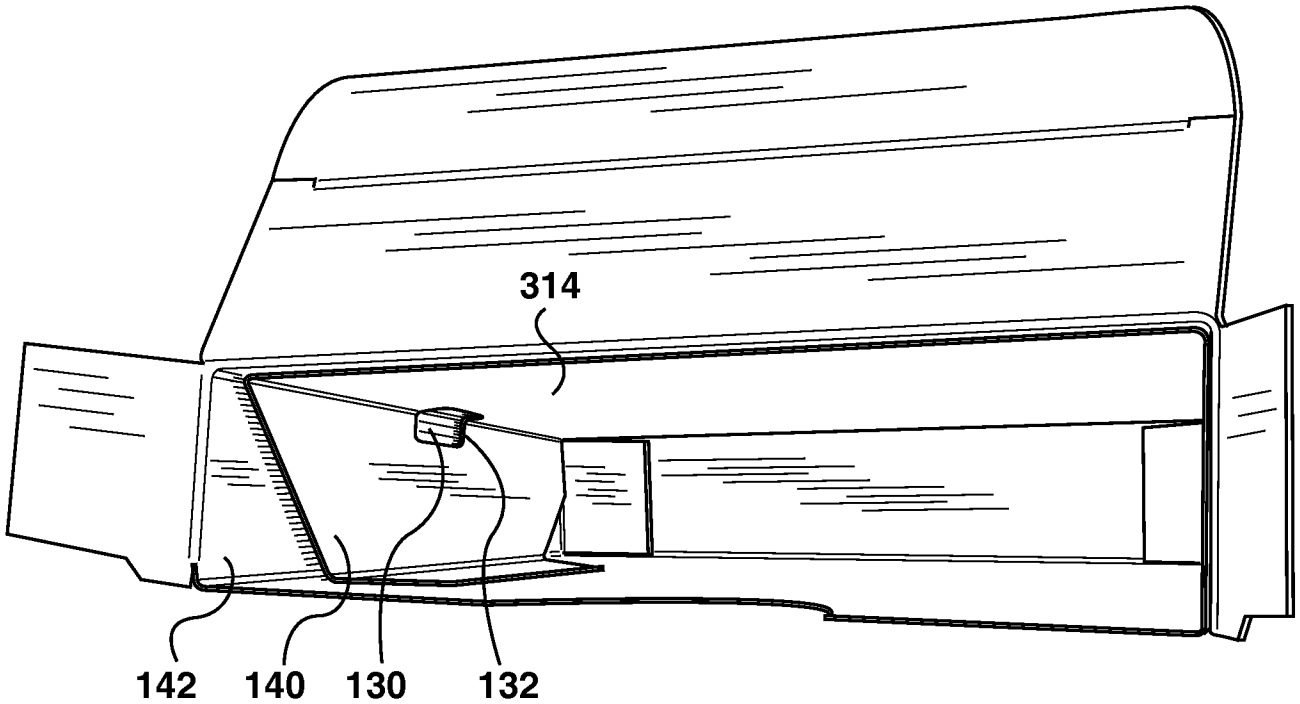
FIG. 5 is a perspective view of the interior of the carton of FIG. 2.

As can best be seen in FIGS. 2, 5 and 6, when the locking tab 122 is in registration with the locking slot 130, pressure exerted by the inner wall 140 on the locking tab 122, and thus on the laterally displaceable region 124, is released. This permits the laterally displaceable region 124, and hence the locking tab 122, to return to the original position. Thus, when in registration with the locking slot 130, the outwardly biased locking tab 122 is biased to move toward and into the locking slot 130, and the locking tab 122 engages an edge of the locking slot 130 to resist withdrawal of the tray 104 from the carton 102. The releasable locking mechanism 120 (FIG. 1) thereby locks the tray 104 inside the carton 102.

The locking slot 130 is formed in the inner wall 140 to releasably receive the locking tab 122. As best seen in FIG.

5, the exemplary locking slot 130 takes the form of an opening cut into the inner wall 140 of the carton 102, and the inner wall 140 of the carton 102 is disposed interiorly of, spaced apart from, and adjacent to an outer wall 142 of the carton 102. In the illustrated embodiment, the locking slot 130 extends beyond the inner wall 140 onto the main inner panel 314; in other embodiments the locking slot may be cut into the inner wall only. In FIG. 5, the locking slot 130 is shown to be generally rectilinear with one rounded edge 132 for engaging the tapered edge 123 of the locking tab 122. However, the locking slot may be of any suitable shape for receiving and engaging a corresponding complementary locking tab to inhibit undesired withdrawal of the tray from the carton. For example, the locking slot may be rectilinear, another polygonal shape, or generally ovoid.

Figure 7C:
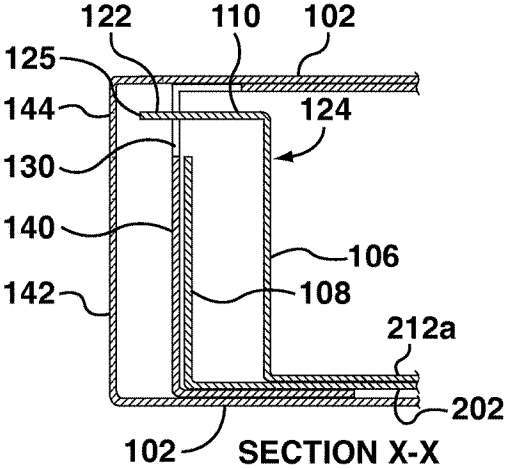
FIG. 7*c* is a cross-sectional view taken along the line X-X in FIG. 7*b* and showing a locking tab of the tray of FIG. 2 received in a locking slot of the carton of FIG. 2.
Figure 7D:
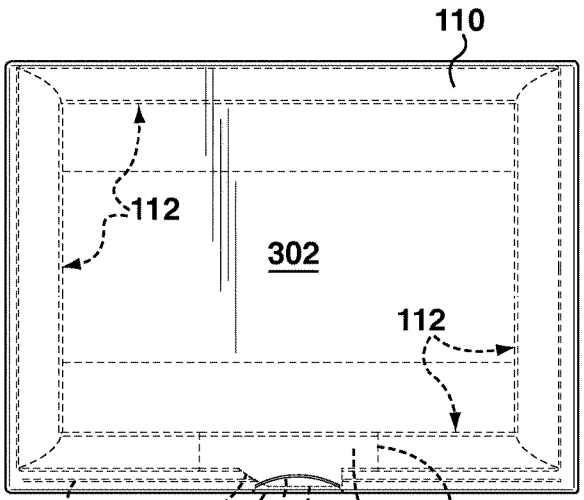
FIG. 7*d* is a transparent top plan view of the tray of FIG. 2 slidably inserted into the carton of FIG. 2 with the carton closed.
Figure 7A:
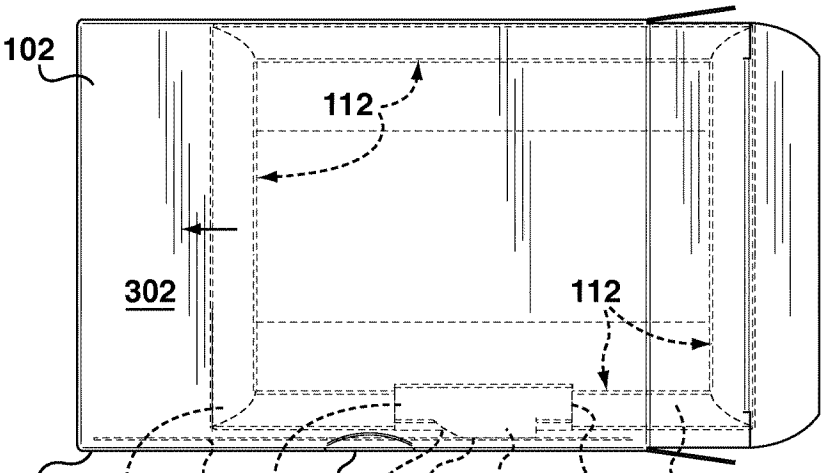
FIG. 7*a* is a transparent top plan view of the carton of FIG. 2 slidably receiving the tray of FIG. 2.
Figure 7B:
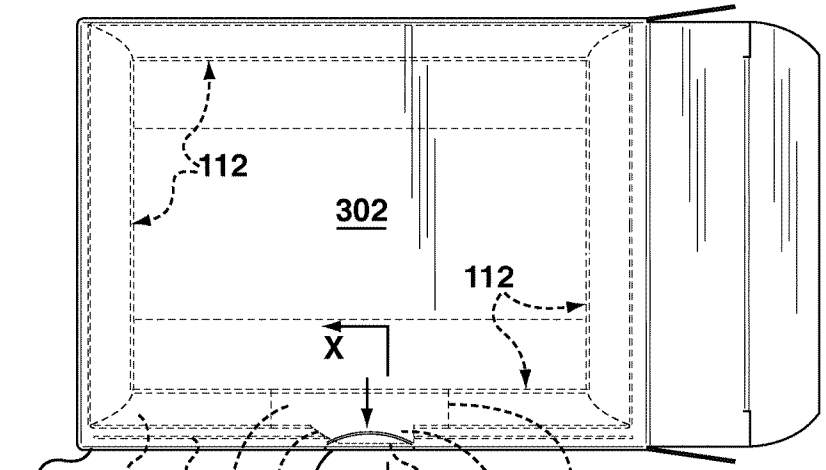
FIG. 7*b* is a transparent top plan view of the carton of FIG. 2 having slidably received the tray of FIG. 2 with the carton open.

FIG. 7*c* is a cross-sectional view showing the locking tab 122 received in the locking slot 130. When received in the locking slot 130, the locking tab 122 extends outwardly beyond the inner wall 140 of the carton 102 and is comfortably enclosed by the outer wall 142 of the carton 102.

FIGS. 8*a* to 8*d* illustrate in detail removal of the tray 104 from the carton 102. To withdraw the tray 104 from the carton 102, the locking tab 122 must be moved out of the locking slot 130. To facilitate this, an inwardly depressible button 144 is formed on the outer wall 142 of the carton 102 adjacent the inner wall 140, with the button 144 being in registration with the locking slot 130.

The exemplary button 144 is formed similarly to the laterally displaceable region 124 located on the tray 104. The outer wall 142 of the carton 102 has two spaced apart splits 146 that define the inwardly depressible button 144. In the illustrated embodiment, two spaced apart slits 146, curved towards each other in a parenthetical shape, form the exemplary button 144. However, similar to the slits 126 on the tray, the slits forming the button may have any suitable shape that defines an inwardly depressible button that is in registration with the locking slot 130. Optionally, the button 144 may have grooves, striations, or be otherwise textured to enhance its flexibility and/or indicate its location.

Figures 8A, 8B, 8C, 8D:
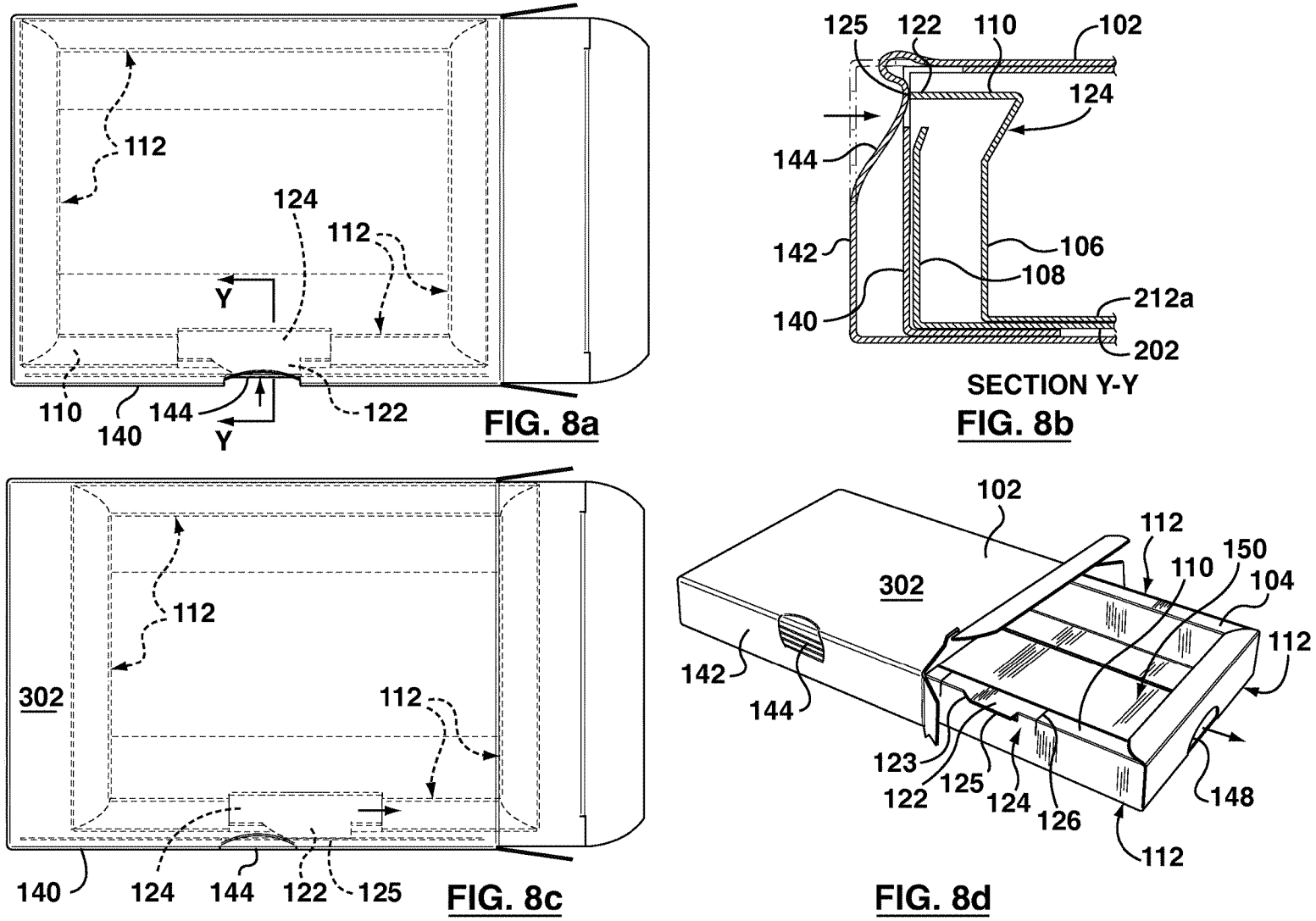
FIG. 8*a* is a transparent top plan view of the carton of FIG. 2 having slidably received the tray of FIG. 2 with the carton open and with a button on the carton inwardly depressed.
FIG. 8*b* is a cross-sectional view taken along line Y-Y in FIG. 8*a* and showing the depressed button engaging the locking tab.
FIG. 8*c* is a transparent top plan view showing the tray of FIG. 2 being slidably withdrawn from the carton of FIG. 2 with the locking tab laterally inwardly displaced.
FIG. 8*d* is a top perspective view showing the tray of FIG. 2 being slidably withdrawn from the carton of FIG. 2 with the locking tab returned to its original position.

Accordingly, when the locking tab 122 is disposed within the locking slot 130, pushing inwardly on the button 144 pushes the outer wall 142 inward toward the locking tab 122, in particular the outer edge 125 of the locking tab 122. The pressure applied to the outer edge 125 of the locking tab 122 by the button 144 pushes the locking tab 122, and the laterally displaceable region 124 carrying the locking tab 122, inwardly so that the locking tab 122 moves inwardly out of the locking slot 130. Once the locking tab 122 is out of the locking slot 130, the locking tab 122, in particular the outer edge 125 thereof, can slide along the inner wall 140. This enables the tray 104 to be slid out of the carton 102 and hence the tray 104 and the carton 102 are no longer locked. As shown in FIG. 8*c*, when the button 144 is pressed fully inwardly, the laterally displaceable region 124 is interiorly displaced, and the outer edge 125 of the locking tab 122 is disposed interiorly of the inner wall 140 of the carton 102. Thus, the outer edge 125 of the locking tab slides along the inner wall 140 of the carton 102 as the tray 104 is withdrawn.

Referring now to FIG. 8*d*, as the tray 104 slides out of the carton 102 and the locking tab 122 is withdrawn from the carton 102 and is no longer in contact with the inner wall 140, the pressure on the locking tab 122 and the laterally displaceable region 124 is released, allowing the laterally displaceable region 124 to return to its original position with the locking tab 122 extending laterally beyond the edge of the tray 104.

Optionally, the tray 104 may also be provided with a grip to assist in grasping the tray 104 while pulling the tray 104 out of the carton 102. This grip may be placed at the edge of the tray 104 opposite the edge that will be inserted into the carton 102. In the illustrated embodiment, an exemplary grip 148 is shown as a cut-out on the exterior side wall 108 of the tray 104. Although not shown, in other embodiments the grip may also be a tab, ribbon or other structure for pulling the tray 104.

An exemplary tray blank 200 for forming the tray 104 will now be described. The tray blank 200, shown in FIG. 9*a*, is of monolithic construction and comprises several panels separated by fold lines 260. The tray blank 200 is generally planar in its unfolded condition and, in a preferred embodiment, is made from paperboard.

The tray blank 200 comprises a rectilinear floor panel 202 from which two opposed side wall panels 204 extend for forming exterior side walls 108 of the tray 104 when the tray blank 200 is in the folded condition. The opposed side wall panels 204 are folded in the same direction. Two opposed end wall panels 206 also extend from the two remaining edges of the rectilinear floor panel 202 for forming exterior end walls 108 of the tray 104 when the tray blank 200 is in the folded condition. Hence, each side wall panel 204 is adjacent to two end wall panels 206 and each end wall panel 206 is adjacent to two side wall panels 204. The opposed end wall panels 206 are folded in the same direction as the side wall panels 204. Ledge panels 208 extend from each of the side wall panels 204 and each of the end wall panels 206 for forming the ledges 110 of the tray 104. Interior wall panels 210 also extend from each ledge panel 208, opposite the respective side wall panels 204 and end wall panels 206, so that in the folded condition, the interior wall panels 210 form the interior walls 106 of the tray 104. As noted above, in the tray 104, the interior walls 106 (formed by the interior wall panels 210) are substantially parallel to the exterior walls 108 (formed by the side wall panels 204 and the end wall panels 206) and spaced therefrom by the ledges 110 (formed by the ledge panels 208). Thus, the interior wall panels 210 form an interior perimeter of the tray 104 and the side wall panels 204 and the end wall panels 206 form an exterior perimeter of the tray 104. When the tray blank 200 is in the folded condition to form the tray 104, the ledge panels 208 will be substantially parallel to the floor panel 202, extending thereover and spaced therefrom by the interior walls 106 (formed by the interior wall panels 210) and the exterior walls 108 (formed by the side wall panels 204 and the end wall panels 206). Although in the illustrated embodiment the interior walls 106 (formed by the interior wall panels 210) are substantially parallel to the exterior walls 108 (formed by the side wall panels 204 and the end wall panels 206) and perpendicular to the floor panel 202, in alternate embodiments the interior walls may slope relative to the exterior walls and floor panel.

Support panels 212*a*, 212*b* extend from the interior wall panels 210 for engaging the floor panel 202 in parallel relation therewith when the tray blank 200 is formed into the tray 104. Side wall support panels 212*a* extend from the interior wall panels 210 opposite the respective side wall panels 204 and end wall support panels 212*b* extend from the interior wall panels 210 opposite the respective end wall panels 206. The support panels 212*a*, 212*b* would typically be glued, taped or otherwise adhered to the floor panel 202. In the embodiments shown in the accompanying figures, the side wall support panels 212*a* are folded in a different direction than the end wall support panels 212*b*. The side wall support panels 212*a* are shown folded inwardly towards the interior of the tray 104 while the end wall support panels 212*b* are folded outwardly. Alternatively, the side wall support panels 212*a* may be folded outwardly so as to leave a smooth tray cavity 150. Similarly, while the end wall support panels 212*b* are shown to fold outwardly in the accompanying figures, the end wall support panels 212*b* may be folded inwardly like the side wall support panels 212*a*.

In the illustrated embodiment, a plurality of tabs 214 extend from the exterior wall panels 204, 206 for reinforcing the assembled tray 104. Continuing to refer to FIG. 9*a*, a pair of opposing tabs 214 extends from each of the side wall panels 204; in an alternative embodiment the tabs may extend from the end wall panels 206. To limit the use of glue or other adhesives, the tabs 214 may be folded and positioned interiorly of the end wall panels 206 (or interiorly of the side wall panels if the tabs extend from the end wall panels). Alternatively, the tabs 214 may be folded and positioned exteriorly of the end wall panels 206 (or exteriorly of the side wall panels 204 if the tabs extend from the end wall panels 206) and secured using an adhesive or other securing means. In other embodiments, the tabs 214 may be omitted altogether; in such embodiments it is preferred to use an alternate reinforcement method, such as taping the junctions of adjacent side wall panels 204 and end wall panels 206 to one another.

Also in the illustrated embodiment, a pair of parallel strips 216 extend from two opposed ledge panels 208 for reinforcing each ledge panel 208 with respect to the adjacent ledge panels 208. Although the parallel strips 216 are shown to extend from the ledge panels 208 extending from the side wall panels 204, they may alternatively extend from the ledge panels 208 extending from the end wall panels 206. The parallel strips 216 are preferably positioned interiorly of the adjacent ledge panel 208 to limit the use of glue, tape or other adhesives. Alternatively, the parallel strips 216 may be omitted. As is the case where the tabs 214 are omitted, if the parallel strips 216 are omitted an alternate reinforcement method should be used, for example taping the junctions of adjacent side wall panels 204 and end wall panels 206 to one another.

As best seen in FIG. 9*b*, a suitably shaped tab slit 218 is cut in one of the side wall panels 204, thereby forming a locking tab 122. When the tray blank 200 is in the unfolded condition, the locking tab 122 extends from the ledge panel 208 toward the floor panel 202 as shown in FIG. 9*a*, and when the tray blank 200 is in the folded condition the tab 122 extends away from the floor panel 202 as shown, for example, in FIGS. 2 and 3. The tab slit 218 may include a slit portion 220 which tapers away from the floor panel 202 when the tray blank 200 is in the unfolded condition, so as to provide the locking tab 122 with a tapered edge 123.

The locking tab 122 is positioned between two spaced apart slits 222 extending from the side wall panel 204, through the adjacent ledge panel 208, and through the adjacent interior wall panel 210. The portions of the side wall panel 204, the adjacent ledge panel 208, and the adjacent interior wall panel 210 between the slits 222 will form the resilient laterally displaceable region 124 when the tray blank 200 is in the folded condition to form the tray 104.

As noted above, the tray 104 may be provided with a grip 148, and on the tray blank 200 a corresponding generally circular area 224 is cut out of the end wall panel 206 opposite the end of the floor panel 202 that will be inserted into the carton 102. The area cut out to form the grip may be any suitable shape, for example, ovoid, rectilinear, or another shape.

Figure 10:
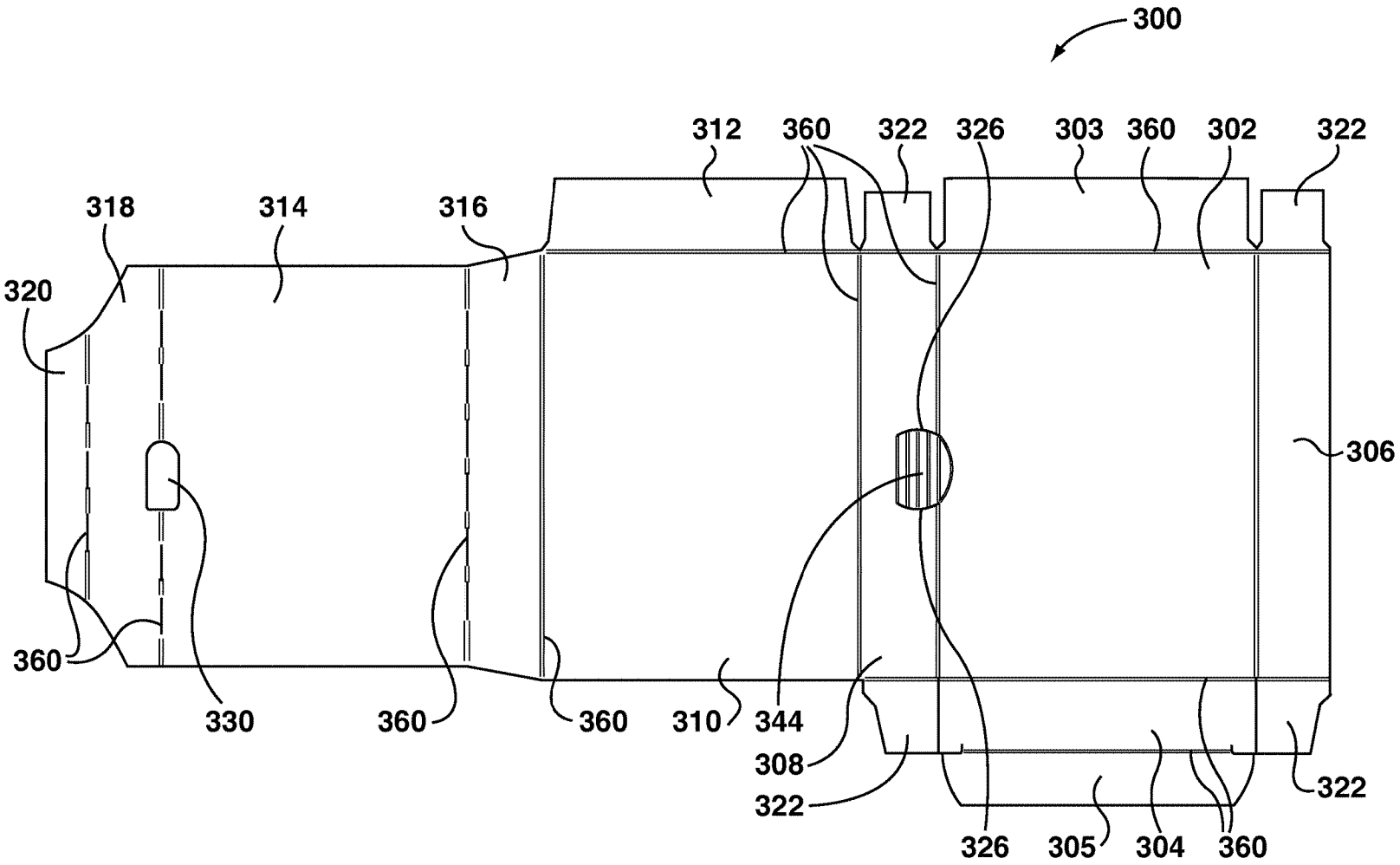
FIG. 10 is a plan view of an exemplary carton blank for constructing the carton of FIG. 2, shown in an unfolded condition.
Figure 11:
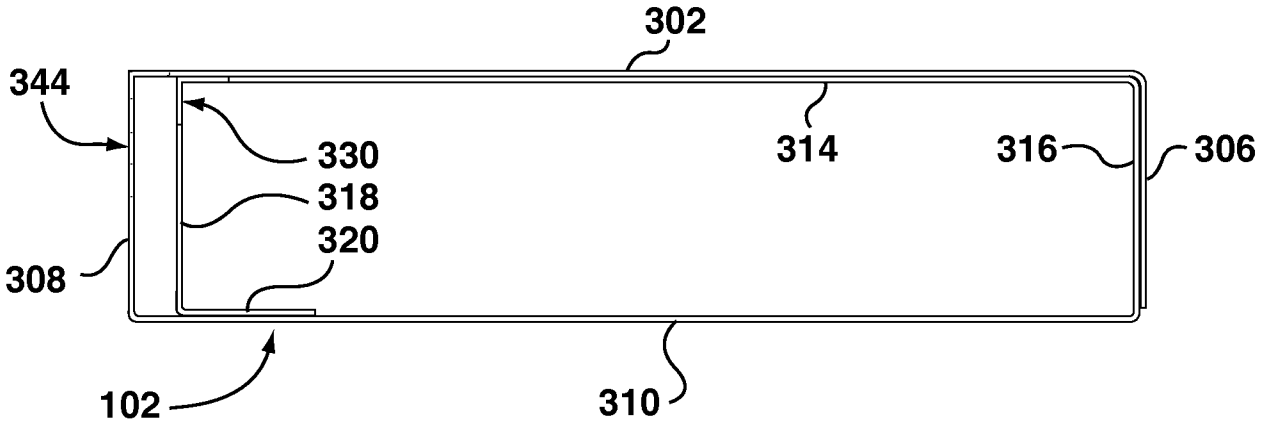
FIG. 11 is a cross-sectional view of the carton blank of FIG. 10 in a folded condition.

An exemplary carton blank 300 for forming the carton 102 will now be described. The exemplary carton blank 300 is of monolithic construction. In its unfolded condition, the carton blank 300 is generally planar and comprises multiple panels separated by fold lines to facilitate folding. In a preferred embodiment, the carton blank 300 is made of paperboard. The exemplary carton blank 300 for forming the exemplary carton 102 is shown in FIGS. 10 and 11.

The carton blank 300 comprises a rectilinear main panel 302. A first main end panel 303 extends from a first side of the main panel 302. A first outer side panel 306 extends from a second side of the main panel 302; the second side of the main panel 302 is adjacent the first side thereof and hence the first main end panel 303 and the first outer side panel 306 are adjacent one another. A second outer side panel 308, which will form the outer wall 142 having the button 144, extends from a third side of the main panel 302 opposite the second side of the main panel 302; the first and second outer side panels 306, 308 are therefore positioned opposite one another. A rectilinear base panel 310 extends from the second outer side panel 308, with the second outer side panel 308 being between the base panel 310 and the main panel 302. In the illustrated embodiment, the base panel 310 has substantially the same dimensions as the main panel 302. When the carton blank 300 is in the folded condition forming the carton 102, the base panel 310 and the main panel 302 form the opposed outer panels of the exemplary carton 102.

A first inner side panel 316 extends from the base panel 310 opposite the second outer side panel 308, so that the base panel 310 is between the first inner side panel 316 and the second outer side panel 308. A main inner panel 314 extends from the first inner side panel 316 opposite the base panel 310; the main inner panel 314 and main panel 302 will be in parallel registration with one another when the carton blank 300 is in a folded condition forming the carton 102. A second inner side panel 318 extends from the main inner panel 314 opposite the first inner side panel 316; the second inner side panel 318 will be the inner wall 140 in the carton 102. The main inner panel 314, first inner side panel 316 and second inner side panel 318 form the inner panels of the carton 102, as best seen in FIG. 11. A support panel 320 extends from the second inner side panel 318, opposite the main inner panel 314. In the folded construction, this support panel 320 rests on the base panel 310 of the carton 102, and would typically be glued, taped or otherwise adhered thereto.

In the illustrated embodiment, a second main end panel 304 extends from a fourth side of the main panel 302 opposite the first side of the main panel 302, and a closure panel 305 extends from the second main end panel 304 opposite the fourth side of the main panel 302. The second main end panel 304 and closure panel 305, together with tabs 322 extending from the first and second outer side panels 306, 308 adjacent to the second main end panel 304, allow one end of the carton 102 to be repeatedly opened and closed in known manner. Optionally, since the tray 104 is lockable in the carton 102, the second main end panel 304, closure panel 305 and adjacent tabs 322 may be omitted such that the end of the carton 102 into which the tray 104 is inserted remains open. Alternative reusable closure structures may also be used.

Also in the illustrated embodiment, a base end panel 312 extends from an end edge of the base panel 310 remote from the closure panel 305. The base end panel 312 and the first main end panel 303 are configured to overlap one another when the carton blank 300 is in the folded condition to form the carton 102, and may, for example, be glued, taped or otherwise adhered to one another to close the carton 102. Adjacent tabs 322 extending from the first outer side panel 306 and second outer side panel 308 may be folded between the base end panel 312 and the first main end panel 303 or disposed interiorly or exteriorly thereof in the assembled carton 102.

FIG. 11 is a cross-sectional view showing the position and relationship of the panels 302, 306, 308, 310, 314, 316, 318 and 320 of the carton blank 300 when folded to form the carton 102.

Referring again to FIG. 10, two spaced apart slits 326 defining an interiorly depressible button 344, which will be the button 144 in the carton 102, are cut into the second outer side panel 308, and the slits 326 may optionally extend onto the main panel 302. A locking slot 330 is cut into at least the second inner side panel 318; this will be the locking slot 130 in the carton 102. In the exemplary embodiment the locking slot 330 straddles the fold line 360 defining the boundary between the main inner panel 314 and the second inner side panel 318. The locking slot 330 is sized and shaped to receive a locking tab from a complementary tray, for example, tray 104. The locking slot 330 positioned so that when the carton blank 300 is in the folded configuration to form the carton 102, the button 344 is in registration with the locking slot 330.

Optionally (not shown), a semi-circular region may be cut out of the end of the base panel 310 opposite the base end panel 312, that is, proximal to the closure panel 305, to assist in opening the carton 102 and reaching the grip 148 of the inserted tray.

Certain features of the exemplary carton will be known to those in the box-making field and are omitted for the sake of simplicity in the description. For example, methods of forming the fold lines are well-known and are not described further.

One or more currently preferred embodiments have been described by way of example. It will be apparent to persons skilled in the art that a number of variations and modifications can be made without departing from the scope of the claims.

What is claimed is:

1. A child-resistant package comprising:

a carton;

a tray;

the tray being removably slidably receivable in the carton so that when received in the carton, contents of the tray are inaccessible;

a releasable locking mechanism for releasably locking the tray in the carton, the releasable locking mechanism comprising:

a laterally displaceable locking tab biased to extend outwardly from the tray;

the locking tab located on a resilient laterally displaceable region in a tray wall, the laterally displaceable region defined by two spaced apart slits in the tray wall;

the carton having an inner wall disposed interiorly of, spaced from and adjacent to an outer wall of the carton;

a locking slot formed in the inner wall for releasably receiving the locking tab;

an inwardly depressible button formed on the outer wall of the carton adjacent the inner wall, the button being in registration with the locking slot; and the locking tab being biased outwardly to move toward and into the locking slot when the tray is received in the carton;

so that, when the locking tab is in registration with the locking slot:

the locking tab is biased toward and into the locking slot;

the locking tab engages an edge of the locking slot to resist withdrawal of the tray from the carton; and inward depression of the button causes the button to engage the locking tab to push the locking tab out of the locking slot to enable the locking tab to slide along the inner wall of the carton so that the tray can be withdrawn from the carton.

2. The child-resistant package as claimed in claim 1, wherein an edge of the locking tab is tapered to guide the locking tab inwardly during insertion of the tray into the carton while the locking tab moves toward the locking slot.

3. The child-resistant package as claimed in claim 1, wherein the locking slot is an opening cut into the interior wall of the carton.

4. The child-resistant package of claim 1, wherein the inwardly depressible button is defined by two spaced apart slits in the outer wall of the carton.

5. The child-resistant package as claimed in claim 1, wherein the tray has a grip for withdrawing the tray from the carton.

6. The child-resistant package as claimed in claim 1, wherein the tray has a tray cavity for containing materials.

7. The child-resistant package of claim 1, wherein the carton and the tray are made of paperboard.

* * * * *